US005975985A

United States Patent [19]

Sutherland et al.

[11] Patent Number: 5,975,985

[45] Date of Patent: Nov. 2, 1999

[54] AUTOMATED SURFACE TREATMENT APPARATUS HAVING CURRENT MONITORING MEANS

[75] Inventors: James Brett Sutherland; Joe David Sutherland, both of Oklahoma City, Okla.

[73] Assignee: Phillips Technologies, Inc., Oklahoma City, Okla.

[21] Appl. No.: 08/960,798

[22] Filed: Oct. 30, 1997

Related U.S. Application Data

[60] Provisional application No. 60/030,172, Oct. 31, 1996.

[51] Int. Cl.[6] ..... B24C 3/00; B24C 7/00

[52] U.S. Cl. ..... 451/2; 451/8; 451/38; 451/95; 451/446

[58] Field of Search ..... 241/35; 451/2, 451/5, 94, 8, 95, 97, 36, 38, 99, 446

[56] References Cited

U.S. PATENT DOCUMENTS

| | | | |
|---|---|---|---|
| 3,841,025 | 10/1974 | Maeda . | |
| 3,867,791 | 2/1975 | Goff . | |
| 4,377,922 | 3/1983 | Bergh . | |
| 4,646,482 | 3/1987 | Chitjian . | |
| 4,693,041 | 9/1987 | Dickson | 451/95 X |
| 4,788,799 | 12/1988 | Dicken | 451/95 X |
| 4,894,959 | 1/1990 | Hoover | 451/95 X |
| 5,142,831 | 9/1992 | Nelson . | |
| 5,231,805 | 8/1993 | Sander . | |
| 5,285,601 | 2/1994 | Watkin et al. . | |
| 5,441,443 | 8/1995 | Roberts . | |
| 5,702,289 | 12/1997 | Champaigne | 451/95 |

*Primary Examiner*—Timothy V. Eley
*Attorney, Agent, or Firm*—Crowe & Dunlevy

[57] ABSTRACT

An apparatus and associated method are disclosed for the treatment of a surface through the projection of an abrading material against the surface. The abrading material is fed from a hopper to a centrifugal blast wheel which projects the abrading material toward the surface, the blast wheel rotated by a blast motor. A controllably positionable valve is disposed between the hopper and the blast wheel to regulate a rate at which the abrading material passes from the hopper to the blast wheel. During operation, a target current to be applied to the blast motor is determined by a control circuit, the target current indicative of a desired rate of abrasion of the surface. The control circuit then measures the current applied to the blast wheel and controls the position of the valve in relation to the target current and the measured current.

13 Claims, 6 Drawing Sheets

AUTOMATED SURFACE TREATMENT APPARATUS HAVING CURRENT MONITORING MEANS

RELATED APPLICATIONS

This application claims the benefit of United States Provisional Application Ser. No. 60/030,172 filed Oct. 31, 1996.

BACKGROUND OF THE INVENTION

1. Field of the Invention

The present invention relates generally to devices for treating surfaces which project an abrading material toward a surface to be treated and more particularly, but without limitation, to automated, portable devices for treating such surfaces.

2. Discussion

Man has developed a wide variety of surfaces and surface treatments for use in a variety of environments. For instance, many business, such as machine shops, manufacturing facilities and a wide variety of others have concrete floors which, over time, may develop a soiled and stained appearance. It is often desirable to resurface the concrete floor. Or perhaps the concrete floor has been painted or given some other surface treatment. Many times it is desirable to remove the paint or surface treatment so that a new surface treatment can be applied. Yet another example is a parking lot that has lines painted on it to facilitate organization of the parking on the surface. It is sometimes desirable to remove the painted on lines and reorganize the parking lot by providing new lines. These are but a few of the great number of surfaces and surface treatments that require maintenance and renovation.

Various devices have been developed to assist in treating these surfaces. For example, U.S. Pat. No. 4,377,922 and U.S. Pat. No. 5,142,831 are somewhat typical of such devices. Each of these prior art devices provide a portable apparatus which includes a centrifugal blast wheel which projects an abrading material, such as steel shot or the like, through a blast corridor onto the surface to be treated. The rebounding abrading material along with any dust or particulate resulting from the treatment of the surface are collected using a rebound corridor and vacuum source. The abrading material is separated from the dust and other particulate and recycled to a hopper which supplies the abrading material to the centrifugal blast wheel.

Although such prior art devices have been useful in treating surfaces, these devices have been fraught with numerous drawbacks and deficiencies. For instance, prior art machines have typically utilized a valve located between the hopper and the centrifugal blast wheel to control the rate of flow of particulate material. This valve has, in the past, been controlled manually and is a very awkward and imprecise. Thus, during use an operator is required to steer the device, control the rate of progression of the device and control the flow of abrading material to ensure a uniform treatment of the surface. These functions often must be simultaneously, making it very difficult to obtain a uniform treatment. This is especially true if the operator has little or no experience using the device.

Even for an experienced operator, prior art devices have been particularly difficult to obtain uniform results at startup and shut down, because the blast intensity has not been adjusted to the rate of forward progression of the device. Once the power cord has been disconnected from prior art machines, these machines have been difficult to move and maneuver without supplying power to the drive system.

Another drawback of prior art machines has been a lack of safety features. Many such devices could provide serious harm to the operator or others because the abrading material can be feed to the centrifugal blast wheel while the device is being repaired, moved and even when the device is tipped on its side.

Thus, while prior art surface treatment devices are known, there remains a need for an improved device which does not suffer from the drawbacks of currently available devices.

SUMMARY OF THE INVENTION

Accordingly, the present invention provides an apparatus and method for treating a surface through the projection of an abrading material against the surface.

Generally, in accordance with a preferred embodiment, the apparatus is provided with a hopper from which the abrading material, such as steel shot, is fed to a centrifugal blast wheel which projects the abrading material toward the surface. A blast motor is provided to rotate the blast wheel.

A controllably positionable valve is disposed between the hopper and the blast wheel to regulate a rate at which the abrading material passes from the hopper to the blast wheel. A microprocessor-based control circuit is provided to control the operation of the apparatus.

During operation, a target current to be applied to the blast motor is determined by the control circuit, the target current indicative of a desired rate of abrasion of the surface. The control circuit then measures the current applied to the blast wheel and controls the position of the valve in relation to the target current and the measured current.

Additionally, the apparatus further preferably includes a drive wheel responsive to a drive motor for moving the apparatus, the operation of the drive motor and the valve controlled by the control circuit during startup and shutdown operations to maintain uniform abrasion of the surface. Other advantageous features include a user-operated activation switch operably coupled to a steering handle which enables ready operation of the apparatus and pivotally mounted wheel assemblies which facilitate ready movement of the apparatus when the apparatus is in a nonoperational condition.

These and various other features as well as advantages which characterize the present invention will be apparent from a reading of the following detailed description and a review of the associated drawings.

DESCRIPTION OF THE DRAWINGS

FIG. 2 is a partially sectional, rear elevational view of the apparatus of FIG. 1.

FIG. 6 is a generalized flow chart for the startup routine representing programming steps stored in memory and executed by the processor of the control circuit.

FIG. 9 is a plan view of the machine status display and control panel.

DETAILED DESCRIPTION

Figure 1:
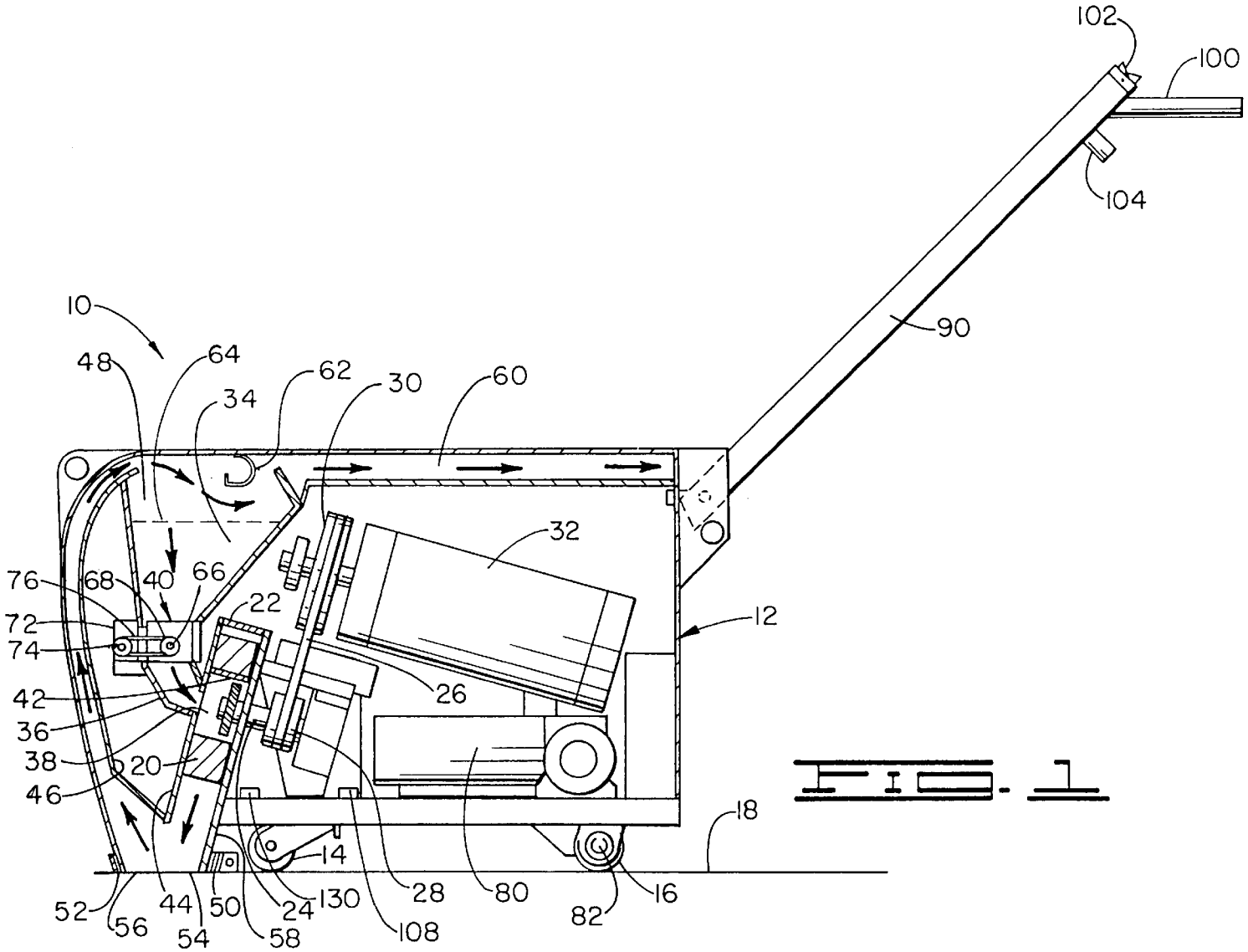
FIG. 1 is a partially sectional, side elevational view of a portable surface treatment apparatus constructed in accordance with the present invention.

With reference to the drawings generally and to FIG. 1 in particular, shown therein is an apparatus for treating surfaces constructed in accordance with the present invention. The apparatus is designated generally by the reference numeral 10.

The apparatus 10 generally comprises a rigid frame 12 mounted on a set of front wheels 14 and a set of drive wheels 16. The front wheels 14 and drive wheels 16 enable movement of the apparatus 10 over a surface 18 to be treated.

The apparatus 10 includes a means for projecting an abrading material, such as steel shot, toward the surface 18. Preferably, the means for projecting the abrading material includes a centrifugal blast wheel 20 enclosed within a protective housing 22. The centrifugal blast wheel 20 is of the type well know to those skilled in the art. The centrifugal blast wheel 20 is rotated at high speed on an axle 24. Preferably, the rotation of the centrifugal blast wheel 20 on the axle 24 is supplied by means of a drive belt 26 that interconnects a pulley 28 on the end of the axle 24 with a motor-driven sheave 30 which is offset from the axis of the centrifugal blast wheel 20. The sheave 30 is driven by means of an electric blast motor 32. Although the present embodiment utilizes an electric blast motor 32, it will be recognized that any suitable motor can be used. In addition, as an alternative to the drive belt 26 and offset, motor-driven sheave 30 arrangement described above, the axle 24 for the centrifugal blast wheel 20 can be directly driven by a motor (not shown).

The abrading material is stored in a hopper 34 located above the centrifugal blast wheel 20 and fed through a spout 36 to a control cage 38 in the center of the centrifugal blast wheel 20. A valve, such as a butterfly valve 40 or a pivot vane, is provided in spout 36 to control the rate at which abrading material flows through the spout 36 to the control cage 38. The control cage 38 dispenses the abrading material to the centrifugal blast wheel 20 which includes a plurality of vanes 42 which extend radially outward from the control cage 38. As the abrading material is metered through an opening (not shown) in the control cage 38 to the inner end of the vanes 42 which are rotating at high speed, the abrading material is forced radially outwardly by the centrifugal force of the rotating vanes 42. The tangential release of the abrading material from vanes 42 can be adjusted by rotating the control cage 38 about its center to carefully position the opening in the control cage 38. The abrading material is thus projected at high speed toward the surface 18, forming a substantially rectangularly shaped cross-sectional pattern which is controlled by the position of the opening in the control cage 38.

A rectangular blast corridor 44 projects angularly upward from near the surface 18 to be treated to the centrifugal blast wheel 20 and is contiguous with the housing 22. The axle 24 for the centrifugal blast wheel 20 is inclined at an angle which is substantially ninety degrees to the angle of the blast corridor 44 so that the rectangular pattern of abrading material is propelled angularly downwardly from the vanes 42 through the blast corridor 44 onto the surface 18. It is well known that the cleaning efficiency and rebounding of the abrading material is somewhat dependent upon the angle of inclination at which the abrading material strikes the surface 18, and will generally form an angle of from about eighty degrees to about thirty degrees with the surface 18.

The kinetic energy of the abrading material striking the surface 18 results in an essentially inelastic collision, causing the abrading material to rebound angularly from the surface 18. Thus, the apparatus 10 includes a rebound corridor 46 that is inclined appropriately to receive the rebounding abrading material. Generally, the rebound corridor 46 forms an angle with horizontal which approximates the angle that the blast corridor 44 forms with horizontal, and will extend curvilinearly upwardly to a collection chamber 48 located above the hopper 34. It will be recognized that the angle of the rebound corridor 46 may be somewhat less or greater than the angle of the blast corridor 44 within the context of the present invention. The precise angle will depend upon the particular needs of the application. For example, in circumstances where it is desirable to treat surfaces bounded by vertical walls which form corners, it may be desirable for the rebound corridor 18 to be ninety degrees to the surface 18 so that the apparatus 10 can be positioned further into the corners.

The blast corridor 44 and the rebound corridor 46 both terminate a short distance above the surface 18. A rear resilient skirt 50, a front resilient skirt 52, and two side resilient skirts 54 are secured to the lower ends of the blast corridor 44 and rebound corridor 46 and extend therefrom substantially into engagement with the surface 18, defining a blast zone 56. The resilient skirts 50, 52, 54 essentially form a seal around the blast zone 56 and prevent abrasive particles from ricocheting from the apparatus 10. The apparatus 10 has a small gap between the rear resilient skirt 50 and the rear wall 58 of the blast corridor 58 to allow air flow into the blast zone 56 during operation. In preferred embodiments, the two side resilient skirts 54 are flanged and to allow for a good seal when treating a surface 18 that has a varying vertical height. The flanges allow the side resilient skirts 54 to flex upwardly and downwardly to follow the changing contour of the surface 18.

An exhaust duct 60 leads from the collection chamber 48 to a vacuum source (not shown). The vacuum source provides air flow through the rebound corridor 46, collection chamber 48, and exhaust duct 60 by drawing air through the gap between the rear resilient skirt 50 and the rear wall 58 of the blast corridor 44, and from between the resilient skirts 50, 52, 54 and the surface 18. The airflow from the vacuum source, along with the kinetic energy of the abrading material, assists the rebounding abrading material to travel the length of the rebound corridor 46 to the collection chamber 48. Dust and other particulate resulting from treatment of the surface 18 become entrained in the airflow and rebounding abrading material and travel through the rebound corridor 46 to the collection chamber 48.

Although in the presently described embodiment as shown in the drawings the rebound corridor is substantially constant in cross-sectional area, various other arrangements are also well suited to the present invention. For example, in an alternative embodiment, the cross-sectional area of the rebound corridor 46 gradually decreases from the lower end substantially throughout the length of the rebound corridor 46 to the collection chamber 48. Such a gradually diminishing cross-sectional area causes an increase in the linear velocity of the air flow as the air travels up through the rebound corridor 46. The increasing velocity of the air flow assists the rebounding abrading material, dust and other particulate to travel the length of the rebound corridor 46 to the collection chamber 48. Those skilled in the art will recognize other suitable arrangements for the rebound corridor 46 that are within the scope of the present invention.

A deflector tube 62 is located in the collection chamber 48 near the discharge end of the rebound corridor 46. The deflector tube 62 serves to stop the forward movement of the abrading material, dust and other particulate. The deflector tube 62 has an opening (not shown) in its lower portion which allows the abrading material to fall into the hopper 34. The dust and other particulate are light enough that they are separated from the heavier abrading material in the collection chamber 48. The vacuum source (not shown) pulls the dust and particulate through the exhaust duct 60 to the vacuum source. The vacuum source will not only include a blower (not shown) which communicates with the exhaust duct 60 to induce air flow through the rebound corridor 46, but will also include a means for separating the dust and other particulate which exists through the exhaust duct 60. The separation means (not shown) may include a filter or dust separator, or a cyclone separator, among others.

A separation grid 64, located between the collection chamber 48 and the hopper 34, screens large particles from the abrading material. After passing through the separation grid 64, the cleaned abrading material accumulates in the hopper 34.

As discussed above, the flow of abrading material from the hopper 34 through the spout 36 to the cage 42 is controlled by the butterfly valve 40. The butterfly valve 40 is disposed within the neck of the spout 36 and includes a shaft 66. A sprocket 68 is mounted on one end of the shaft 66, and an encoder 70 is mounted on the other end. A DC motor assembly 72 is mounted adjacent the spout 42 which drives a sprocket 74. A belt, preferably a timing belt 76, operably connects sprocket 68 and 74 and enables the DC motor assembly 72 to selectively pivot the shaft 66, thereby varying the opening of butterfly valve 40. The encoder 70 on the shaft 66 monitors the position of the butterfly valve 40 and provides this information to a control circuit 78 which in turn provides a control signal to the DC motor assembly 72 to vary the opening of the butterfly valve 40, as discussed below.

A drive motor 80 provides power to the drive wheels 16 and is used to propel the apparatus 10 across the surface 18. The drive wheels 16 are mounted on a shaft 82 which includes a sprocket 84 (as shown in FIG. 2). The drive motor 80 powers a drive sprocket 86 which is interconnected by a chain 88 to the sprocket 84. Thus, as the drive motor 80 turns the drive sprocket 86, the chain 88 turns the sprocket 84 and the shaft 82 to power the drive wheels 16. The control circuit 78 provides a control signal to the drive motor 80 and regulates the direction and speed of the propulsion of drive wheels 16, as discussed below.

Figure 4:
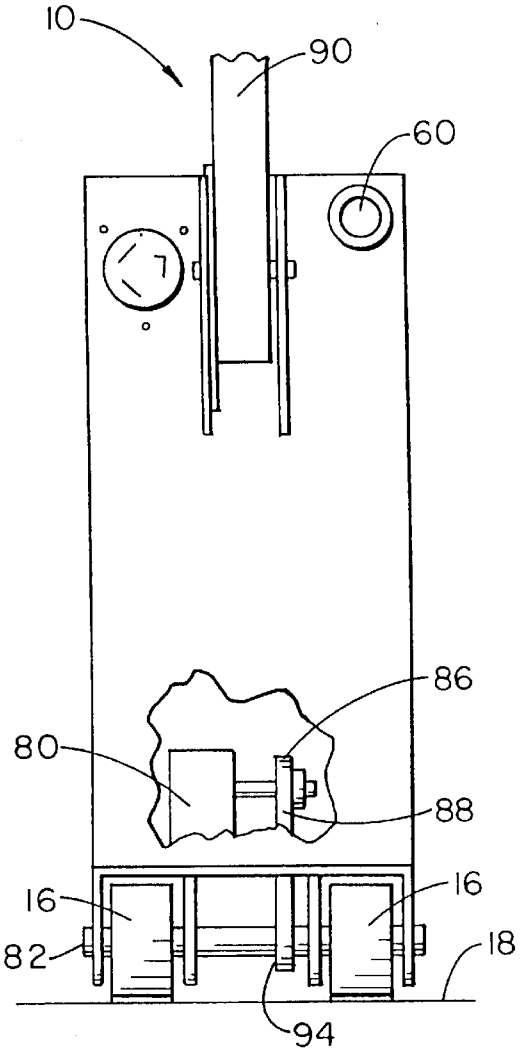
FIG. 4 is a sectional view of the pivotal attachment of the handle to the frame for the apparatus of FIG. 1.
Figure 4:
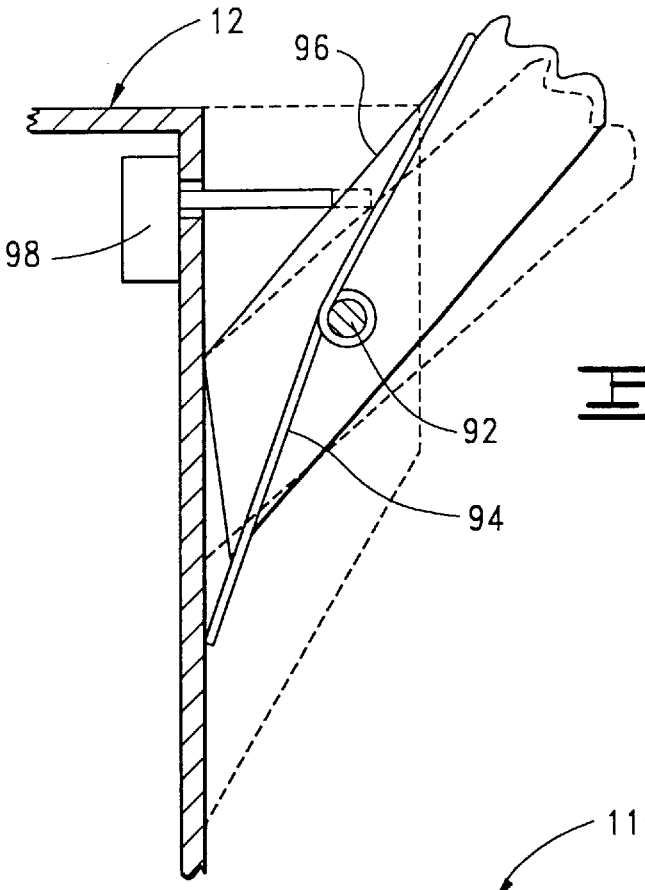
Figure 3:
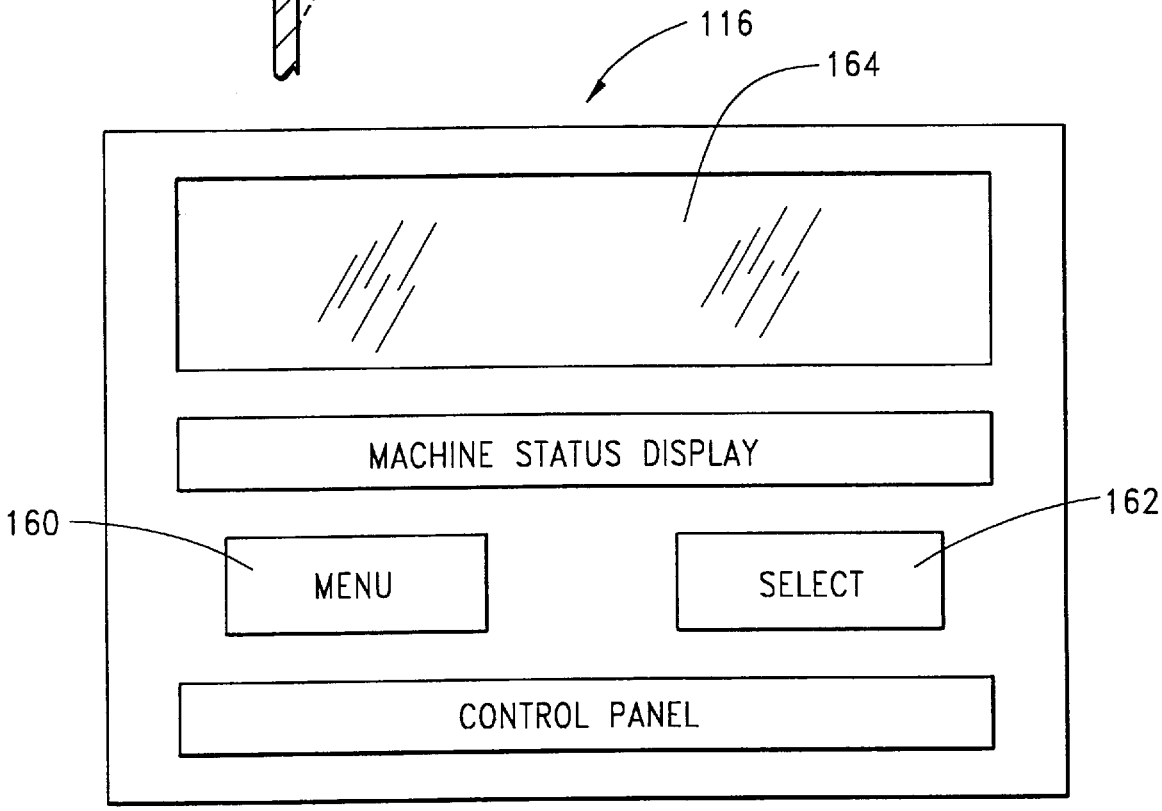

A handle 90 is provided to facilitate control of the apparatus by the operator. The handle 90 is pivotally attached to the frame 12 by means of a pin 92 (shown in greater detail in FIGS. 2 and 4). A spring 94 biases the handle 90 to rotate about the pin 92 toward an up position. In this position, a flange 96 contacts a handle switch 98 which communicates with the control circuit 78. When the handle is in the up position the apparatus 10 cannot be propelled and cannot open butterfly valve 40 to supply shot to the centrifugal blast wheel 20. This is a significant safety feature of the device. The operator thus holds a handle grip 100 and pushes the handle 90 downwardly to deactivate the handle switch 98 to enable the apparatus 10. At the upper end of the handle is a forward/reverse rocker switch 102 which can easily be manipulated by the operator with his thumb. The forward/reverse rocker switch 102 is a three position switch which communicates with the control circuit 78 to control the direction of propulsion, i.e., forward, neutral or reverse. A fingertip speed control knob 104 is also conveniently located on the handle and provides a signal to the control circuit 78 which allows the operator to adjust the linear velocity of the apparatus 10.

Figure 3:
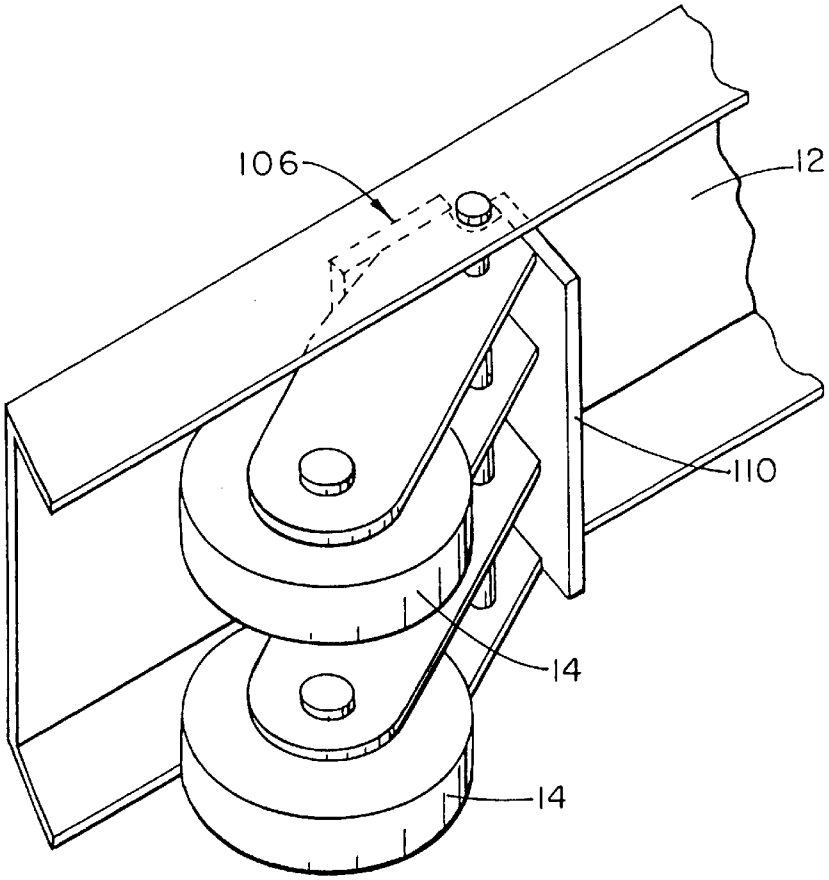
FIG. 3 is a perspective view of the pivotal front wheels of the apparatus of FIG. 1.

The apparatus 10 also includes an advantageous feature which allows the apparatus 10 to be easily moved without propulsion of the rear wheels 16, e.g., when the machine is not connected to an electrical outlet. In this regard, the front wheels 14 of the apparatus 10 are pivotally mounted to the frame 12 in a manner which allows the front wheels 14 of the machine to be placed in either of two positions (see FIG. 3 for greater detail). In the operating position, the front wheels 14 are pivoted toward the blast zone until a forward flange 106 contacts the frame 12. The forward flange 106 contacts a wheel switch 108 which communicates with the control circuit 78. With the front wheels 14 in this lower, operating position the apparatus is in proper position to begin treatment of the surface, i.e., the skirts 50, 52, 54 and the drive wheels 16 to engage the surface 18. If the device tilts or in any way disengages the forward flange 106 from contact with the wheel switch 108, the control circuit 78 immediately shuts down the machine. This is another significant safety feature of the apparatus 10.

In the travel position the front wheels 14 are pivoted toward the rear wheels 16 until the rear flange 110 contacts the frame 12. The rear flange 110 is angled differently from the forward flange 106 such that when the front wheels 14 are in the travel position the front wheels extend further below the frame 12. In this position, the apparatus 10 will rest upon the front wheels 14 only, and the skirts 50, 52, 54 and the drive wheels 16 do not contact the surface 18. The operator can then easily maneuver the apparatus 10 using the handle 90, so that the apparatus can be moved without power to the machine. In this travel position, the forward flange 106 does not contact the wheel switch 108, and therefore, the control circuit 78 will not enable the drive motor 80 or butterfly valve 40.

The apparatus 10 also includes side safety switches 112, 114, which are positioned to contact the side panels (not shown) of the apparatus 10. If either of the side panels are removed from the machine, either before or during operation of the machine, the control circuit 78 shuts down the apparatus 10. This is yet another safety feature of the apparatus 10.

Electrical System Operation

Figure 5:
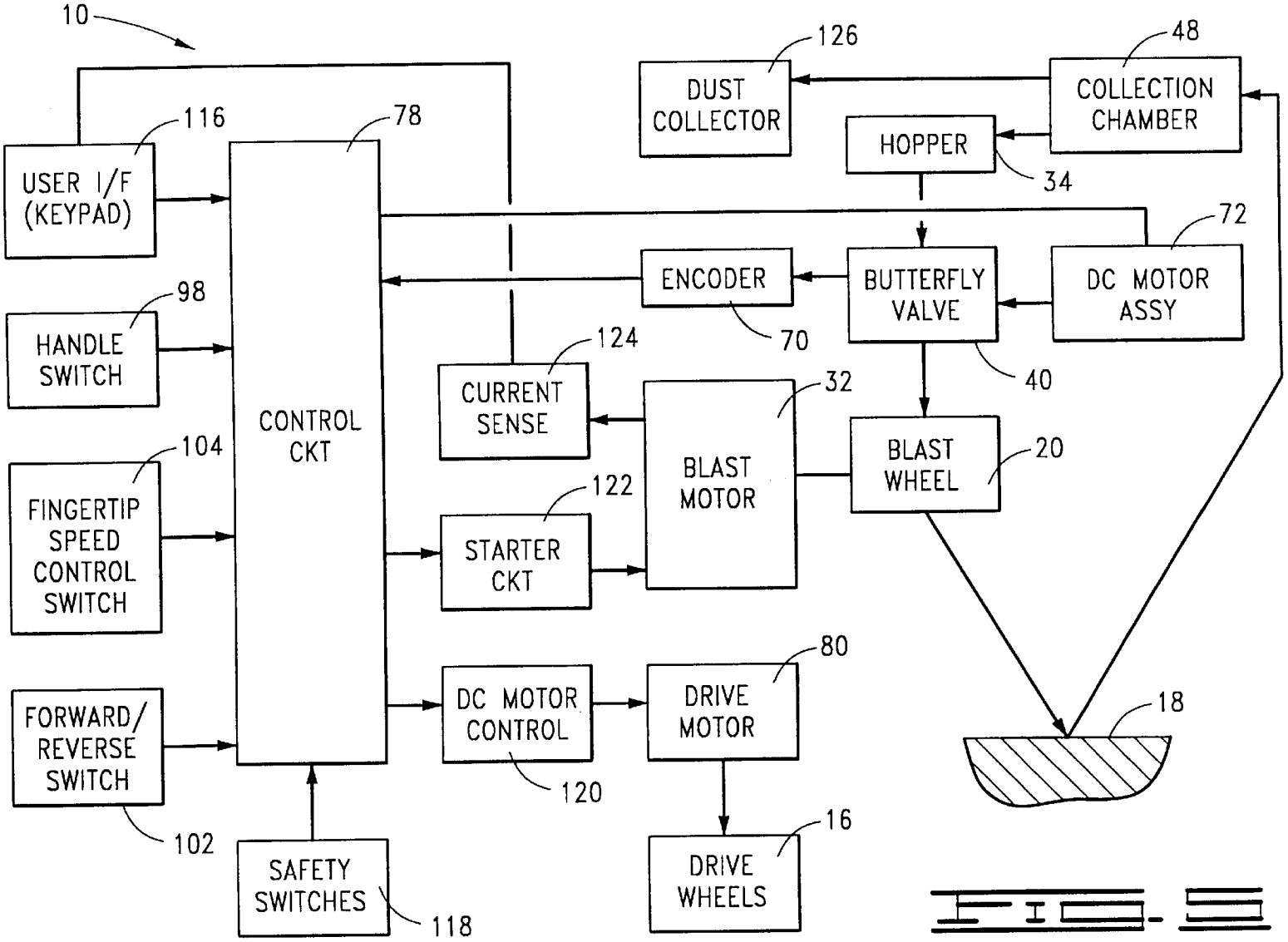
FIG. 5 is a functional block diagram of the apparatus of FIG. 1, generally illustrating the functional interrelationships and control of the mechanical systems.

Referring now to FIG. 5, shown therein is a functional block diagram of the apparatus 10, generally illustrating the functional interrelationships and control of the systems described above.

As shown in FIG. 5, the control circuit 78 comprises a processor, memory and associated control and communication components (not separately shown) which provide overall control of the apparatus 10 in a manner to be discussed in greater detail below. A user interface 116, comprising an LCD display and a membrane keypad (not separately shown), displays instruction and status information and allows the user to change the operational parameters for the apparatus 10. Additionally, the handle switch 98, the fingertip speed control switch 104 and the forward/reverse rocker switch 102 discussed above are represented in FIG. 5 and provide user activated commands to the control circuit 78.

The safety switches provided to contact the side panels and the front wheels 14 are collectively denoted at block 118 and provide interrupt signals to the control circuit 78. At such times that one of these safety switches is opened during operation of the apparatus 10, the control circuit 78 issues the necessary commands to shut down the apparatus 10, preventing the risk of injury to the user.

A DC motor control circuit 120 receives a control input from the control circuit 78 and, in response thereto, provides current to the drive motor 80 in order to power the drive wheels 16. The direction and speed of the apparatus 10 is thus determined by the control input provided to the DC motor control circuit 120. The control of the DC motor control circuit 120 will be discussed in greater detail below.

FIG. 5 further includes a conventional motor starter circuit 122 comprising a pair of relays and corresponding motor start capacitors (not shown), to allow the blast motor 32 to operate using either 110 or 220 VAC input power as desired. In response to a start motor command from the control circuit 78, the starter circuit 122 engages the appropriate relay/capacitor combination and brings the blast motor 32 and the blast wheel 20 up to an initial operating speed. It will be recognized that at startup, no abrading material is provided to the blast wheel 20. A current sense 124, preferably comprising a ferrite element surrounding a selected one of the power cables running to the blast motor 32, senses the current applied to the blast motor 32 and provides an indication of the same in the form of a current sense signal to the user interface 116, which in turn provides the current sense signal to the control circuit 78.

The abrading material used to blast the surface 18 is initially provided in the hopper 34. Once the blast motor 32 is up to speed, the DC motor assembly 72 opens the butterfly valve 40 in response to a control signal from the control circuit 78 in order to initiate the surface treatment process, so that abrading material passes from the hopper 34, passes through the butterfly valve 40 as described above and down to the blast wheel 20, which propels the abrading material against the surface 18. The resulting mixture of abrading material and dust residue is directed to the collection chamber 48, which directs the abrading material for reuse to the hopper 34 and directs the dust residue to the dust collector (identified at 126). As discussed above, the dust collector 126 comprises a conventional vacuum and filter assembly which accumulates the dust residue from the operation of the apparatus 10 and, as such, is not germane to the present invention. Finally, FIG. 5 shows the encoder 70 which provides valve position signals to the control circuit 78.

Having concluded an overview of FIG. 5, the manner in which the apparatus 10 operates will now be discussed. As provided above, the apparatus 10 operates under microprocessor control to blast (or treat) the surface 18. Thus, controlled startup and shut down routines are executed during operation of the apparatus 10, and these routines are set forth in FIGS. 6 and 7.

Beginning with FIG. 6, shown therein is a generalized flow chart for the startup routine representing programming steps stored in memory and executed by the processor of the control circuit 78. It will be recognized that the startup routine of FIG. 6 is initiated by the user by depressing the handle 90, activating the handle switch 98. Once the routine is initiated, as shown by block 127 the control circuit 78 measures the input voltage supplied to the apparatus 10, determining not only the selected voltage range (nominally 110 or 220 VAC) but also the actual voltage (for example, 108 or 226 VAC) at the AC input to the apparatus 10. Such determination is necessary to accurately calculate the full load current for the blast motor 32, which is then performed as shown by block 128. The full load current is defined as the maximum current required by the blast motor 32 to propel a maximum rate of abrading material towards the surface 18 (e.g., when the butterfly valve 40 is in the fully open position). For example, in the presently preferred embodiment the full load current for the blast motor 32 at a nominal input voltage of 110 VAC is about 18 amps, whereas the full load current at a nominal input voltage of 220 VAC is about 9 amps. Of course, the actual full load current value determined by block 128 will depend upon the construction and size of the motor, the construction of the blast wheel and the actual input voltage available at the AC input to the apparatus 10. Further, the full load current value can be determined either through calculation or by reference to a predetermined current table stored in memory. It will be recognized that the actual current used by the blast motor 32 will depend upon the amount of abrading material supplied to the blast wheel 20 and that the load current will be lowest when the butterfly valve 40 is closed.

Once the full load current for the blast motor 32 is determined, the preselected blast intensity is recalled by block 130. As discussed above, the blast intensity is a value between zero and one hundred percent indicative of the relative amount of abrading material that is to be passed through the butterfly valve 40, with one hundred percent corresponding to the butterfly valve 40 in the fully open position. The blast intensity value is stored in memory and is subsequently used each time the apparatus 10 is powered up; the blast intensity value can also be changed by the user by way of the user interface 116, as described more fully below. Alternatively, the blast intensity value can be assigned a default value (such as forty percent) which is provided upon power up 10, subject to being changed by the user through the user interface 116.

Continuing with FIG. 6, once the blast intensity is recalled, a target current for the blast motor 32 is then determined by block 132, by multiplying the full load current determined by block 128 with the blast intensity of block 130. The target current will thereafter be used to control the rate of abrading material applied to the blast wheel 20.

Having determined the target current, the blast motor 32 is powered up and allowed to reach operating speed, as indicated by block 134. The routine of FIG. 6, then performs dual path operations upon the butterfly valve 40 and the drive motor 80; that is, the butterfly valve 40 is incrementally opened in a ramped fashion while the drive motor 80 is ramped up to speed in order to assure consistent blasting results. More particularly, the routine of FIG. 6 initiates a ramped opening of the butterfly valve 40 at block 136, wherein the DC motor assembly 72 is instructed to open the butterfly valve 40 an initial amount, allowing some abrading material to pass through to the blast wheel 20. The current sense 124 provides the current sense signal to the user interface 116, and hence, to the control circuit 78, which compares the current to the blast motor 32 with the target current determined above in block 132. The control circuit 78 then commands the DC motor control assembly 72 to open the butterfly valve 40 a second amount, further loading the blast motor 32 and increasing the load on the blast motor 32. This closed loop routine is performed over a series of intervals until the load current approximates the target current, after which the control circuit 78 enters a normal mode of operation wherein the DC motor control assembly 72 is modulated by the control circuit 78 to nominally maintain the load current equal to the target current. In the preferred embodiment, the range over which the valve can be opened is divided into discrete steps (for example, 300)

and each operation of the DC motor control assembly 72 opens the valve a selected number of steps (for example, 20 steps/operation). The profile used to open the butterfly valve 40 can be essentially linear, or can be defined exponentially with increasing (or decreasing) numbers of steps in each operation. Preferably, the profile is stored in memory in the form of a ramp table and retrieved by the control circuit 78 when needed.

At the same time that the routine begins the ramp valve open operation of block 136, the routine also provides a timed delay (as indicated by block 138) and then proceeds to ramp the drive motor 80 (as indicated by block 139), accelerating the apparatus 10 forward. The drive motor 80 is accelerated by applying successive control signals to the DC motor control circuit 120 to provide increasing amounts of current to the drive motor 80 until the actual velocity reaches a target velocity selected by the user (by way of the user interface 116 or the fingertip speed control switch 104). A default target velocity can also be supplied, or the most recently selected target velocity can be stored and reused each time the apparatus 10 is powered up, subject to change by the user. For reference, the target velocity is measured in feet per minute, with typical values being from 5–10 ft/min. The ramp profile used by the control circuit 78 in accelerating the drive motor 80 can be either linear or exponential, as desired, and is preferably stored in the form of a table in memory.

The ramping of the butterfly valve 40 and the drive motor 80 provides a significant advantage over the prior art; particularly, it will be recognized that such ramping allows the apparatus 10 to provide essentially uniform blast results over the entire surface 18, including that portion of the surface 18 where the apparatus 10 accelerates from rest. The purpose for the delay at block 138 is synchronize the abrading material rate with the acceleration of the apparatus 10; it has been found desirable to lag the acceleration of the apparatus 10 slightly behind the ramped opening of the butterfly valve 40 in order to assure uniform blasting results. Typically, such delay is on the order of around 250 milliseconds, but the amount of the delay, if required at all, will depend upon the particular construction of a given apparatus.

Once the butterfly valve 40 is opened so that the load current of the blast motor 32 is reached the target current and the drive motor 80 is fully accelerated so that the velocity of the apparatus 10 reaches the target velocity, the startup routine of 12 ends in favor of a steady-state mode of operation, during which an extended portion of the surface 18 is blasted. During the steady-state mode, the apparatus 10 operates to maintain the load current of the blast motor 32 proximate the target current and the actual velocity of the apparatus 10 proximate the target velocity. The user can adjust the velocity of the apparatus 10 by way of the fingertip speed control switch 104 as desired. It is contemplated that the apparatus 10 will be used to blast the surface 18 in a series of adjacent, long strips, maximizing the time that the apparatus 10 operates in the steady-state mode of operation. Although the apparatus 10 is self-propelled and will nominally follow a straight path, course corrections as required can be readily performed by the user by "steering" the apparatus 10 side-to-side with the handle 90.

Figures 5, 7:
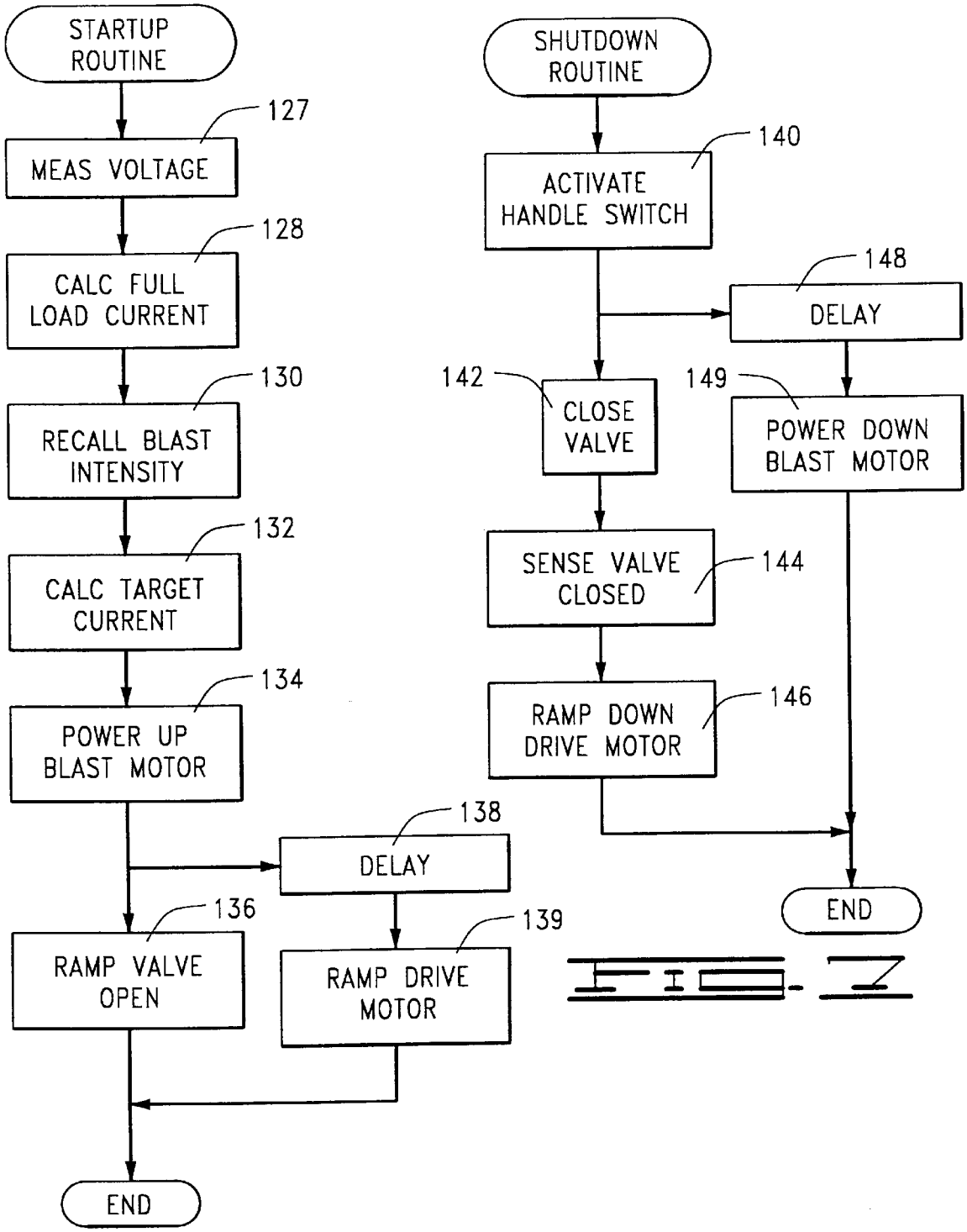
FIG. 7 is a generalized flow chart for the shutdown routine representing programming steps stored in memory and executed by the processor of the control circuit.

Another advantage of the apparatus 10 is a shut down routine which is preferably used when the apparatus reaches the end of each particular strip of the surface 18 and this shut down routine is shown in FIG. 7. Referring to FIG. 7, the routine is initiated by the user at block 140 by deactivating the handle switch 98. As described above, the handle is spring biased so that the apparatus 10 is activated and operated only so long as the handle is depressed downwardly, activating the handle switch 98. By releasing the handle, the switch 98 is deactivated, initiating dual paths of operation by the remainder of the shut down routine, as shown. The first of these paths begins with block 142, wherein the butterfly valve 40 is closed. Whereas the closing of the butterfly valve 40 could be performed in a ramped fashion similar to that discussed above with respect to the ramp open operation of block 136 of FIG. 6, block 142 preferably operates to immediately close the butterfly valve 40. At such time that the encoder 70 senses that the butterfly valve 40 is fully closed, as indicated by block 144, the drive motor 80 is ramped down as indicated by block 146, decelerating the apparatus 10 to a stop. The ramping down of the drive motor 80 is performed so that the apparatus 10 moves forward about six inches beyond the point at which the butterfly valve 40 was determined to be closed (block 144), in order to vacuum up any abrading material remaining on the surface 18. The control circuit 78 determines the necessary control command profile for the DC motor control circuit 120 based upon the operating velocity of the apparatus 10 at the beginning of the deceleration and a table provided in memory. Alternatively, the control circuit 78 simply shuts off the drive motor 80 once the appropriate distance has been traversed after the butterfly valve 40 is closed; the chain and sprocket arrangement between the drive motor 80 and the drive wheels 16 will typically minimize the tendency of the apparatus 10 to "coast" once power is removed from the drive motor 80.

Additionally, after the handle switch 98 is deactivated by block 140, the shut down routine of FIG. 7 provides a predetermined time delay, as shown by block 148, after which the blast motor 32 is powered down by the control circuit 78, as shown by block 149. The purpose for the delay is to synchronize the closing of the butterfly valve 40 with the powering down of the blast motor 32. In the preferred embodiment, once the handle switch 98 is deactivated by the user, the butterfly valve 40 is closed and the drive motor 80 and the blast motor 32 are shut down in a safe and controlled fashion. This allows the user to thereafter engage the front wheels 14 by lifting the rear portion of the apparatus 10 with the handle and swinging the front wheels 14 into place. Once front wheels 14 are engaged, the apparatus can be readily positioned for a new strip of the surface 18, the user can disengage the front wheels 14 by again lifting the handle 90 and can reengage the apparatus 10 by depressing the handle 90, initiating the startup routine of FIG. 6. As discussed above the front wheels 14, when engaged, will prevent operation of the apparatus 10 as a result of the associated safety switch 108, ensuring the safety of the user. Alternatively, the user can place the forward/reverse switch 102 (on the handle) in the "reverse" setting, causing the drive motor 80 to drive the apparatus 10 backwards. It will be recognized that the blast motor 32 is disabled at such times that the forward/reverse switch 102 is set to "reverse," and that normal operation of apparatus 10 requires the forward/reverse switch 102 to be set to "forward."

Figure 8:
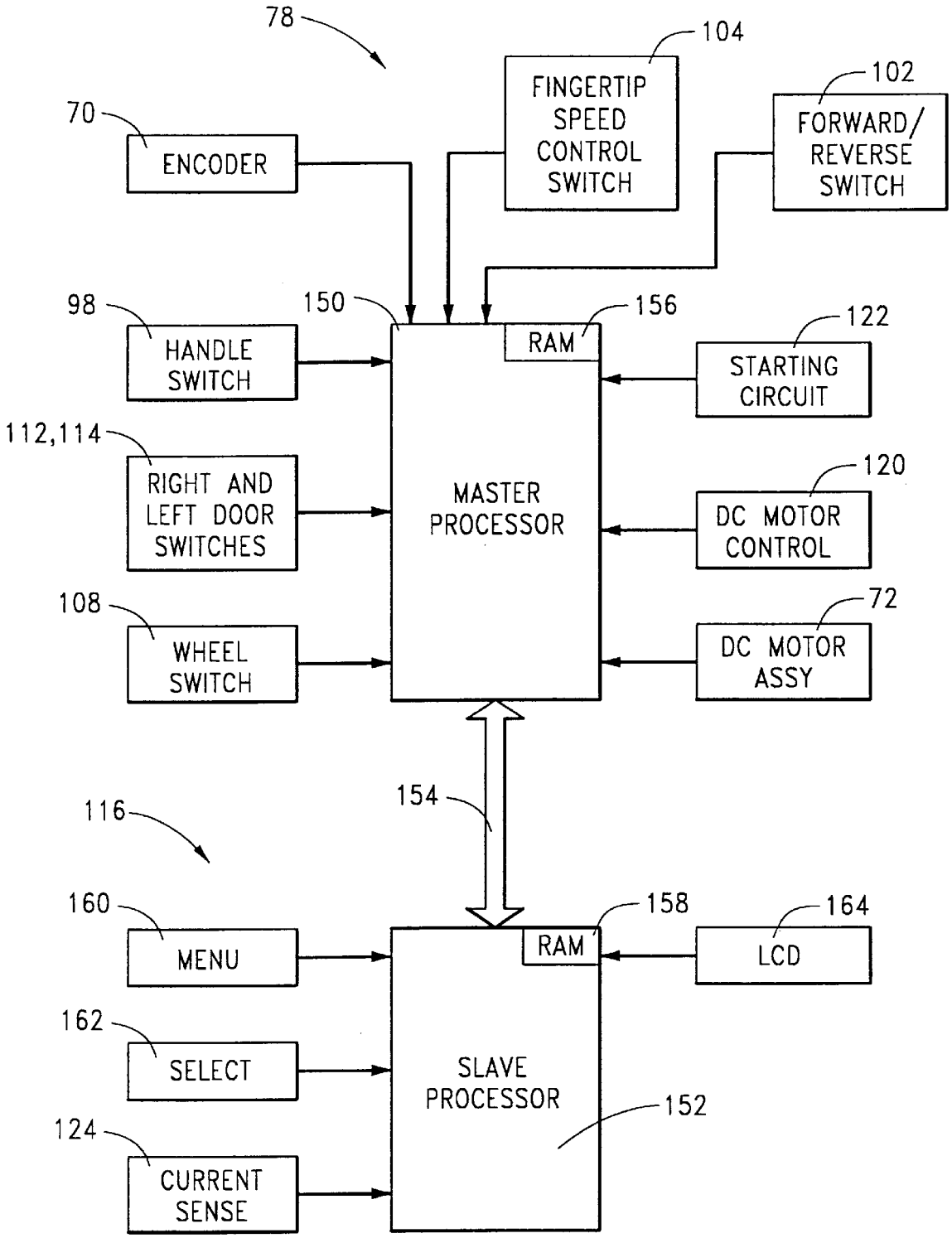
FIG. 8 is a schematic functional diagram of the control circuit and the user interface of FIG. 5 in greater detail.

Having concluded a discussion of the startup and shut down routines of FIGS. 6 and 7, reference is now made to FIG. 8, which provides a schematic functional diagram of the control circuit 78 and the user interface 116 of FIG. 5 in greater detail. Particularly, FIG. 8 shows the control circuit 78 to include a master processor 150 which communicates with a slave processor 152 of the user interface 116 by way of a conventional RS-232 interface 154. The master processor 150 and slave processor 152 can be any one of a number of commercially available processors/controllers and include memory (such as the RAM 156, 158) for storage of programming steps, tables and system parameters as required.

As discussed above, the master processor 150 provides overall control of the apparatus 10 and receives interrupt signals from the handle switch 98, right and left door safety switches (112, 114) and the wheel switch (108). Additionally, control/status inputs are provided to the master processor 150 from the encoder 70, the fingertip speed control switch 104 and the forward/reverse switch 102, as discussed above.

The slave processor 152 operates as an interface to the master processor 150 and controls the user display provided on the top of the apparatus 10. Particularly, the slave processor 152 receives the current sense signal from the current sense 124 and passes this information to the master processor 150 by way of the interface 154. Additionally, menu and select membrane pads 160, 162 are provided for inputs to the slave processor 152 by the user, as discussed below. An LCD user display 164 displays status, command query and error code messages to the user.

Initially, when the apparatus 10 is powered up and ready for use, the slave processor 152 provides a "Press Handle" indication to the user on the LCD 164, instructing the user to begin operation by depressing the handle to initiate the startup routine of FIG. 6. At such time that the handle is depressed, the LCD displays the velocity (in feet/minute) of the apparatus 10, and updates this value accordingly as the velocity is changed by the user by way of the fingertip speed control switch 104 on the handle. By selective use of the menu and select pads 160, 162, the user can scroll through a sequence of menu displays to select the blast intensity (from zero to one hundred percent, as described above) and the target velocity (feet/min.), as desired. The blast intensity and the target velocity are stored in the RAM 156 and provided to the master processor 150 during the startup routine of FIG. 6.

The user can also scroll through the sequence of menu displays to obtain elapsed time and serial number information, such information being stored by the slave processor 152 in RAM 158. Finally, interrupts or other error conditions (such as voltage faults) reported to the master processor 150 are provided to the slave processor 152 for display of the same to the user by way of the LCD 164. For reference, the LCD 164 and the menu and select pads 160 and 162 are generally shown in FIG. 9.

It will be clear that the present invention is well adapted to attain the ends and advantages mentioned as well as those inherent therein. While presently preferred embodiments have been described for purposes of disclosure, numerous changes may be made which will readily suggest themselves to those skilled in the art and which are encompassed in the spirit of the invention disclosed and as defined in the appended claims.

What is claimed is:

1. In a surface treatment apparatus in which an abrading material is projected against a surface to be treated, wherein the abrading material is fed from a hopper to a centrifugal blast wheel which projects the abrading material toward the surface, wherein a blast motor is provided to rotate the centrifugal blast wheel and wherein a controllably positionable valve is disposed between the hopper and the centrifugal blast wheel to establish a rate at which the abrading material passes from the hopper to the centrifugal blast wheel, a method for uniformly applying the abrading material to the surface, comprising the steps of:

(a) measuring current applied to the blast motor during operation of the blast motor; and (b) adjusting the position of the valve to regulate the rate at which the abrading material passes from the hopper to the centrifugal blast wheel in relation to the measured current.

2. The method of claim 1, further comprising the step of:

(c) determining a target current to be applied to the blast motor indicative of a desired rate of abrasion of the surface by the abrading material.

3. The method of claim 2, wherein step (b) further comprises the steps of:

(i) comparing the measured current to the target current; and (ii) adjusting the position of the valve in relation to a difference between the measured current and the target current.

4. The method of claim 2, wherein step (c) further comprises the steps of:

(i) measuring voltage available to the blast motor;

(ii) determining a blast intensity value indicative of a relative rate of abrasive material to be passed through the valve; and (iii) determining the target current in relation to the measured drive voltage and the blast intensity value.

5. A method for uniformly applying an abrading material to a surface by way of a surface treatment apparatus in which the abrading material is projected against the surface to be treated, the apparatus having a hopper from which the abrading material is fed to a centrifugal blast wheel which projects the abrading material toward the surface, the apparatus further having a blast motor for rotating the centrifugal blast wheel and a controllably positionable valve disposed between the hopper and the centrifugal blast wheel for establishing a rate at which the abrading material passes from the hopper to the centrifugal blast wheel, the method comprising the steps of:

(a) determining a target current to be applied to the blast motor indicative of a desired rate of abrasion of the surface by the abrading material;

(b) measuring current applied to the blast motor as the blast motor is operated; and (c) adjusting the position of the valve to regulate the rate at which the abrading material passes from the hopper to the centrifugal blast wheel in relation to the measured current and the target current.

6. The method of claim 5, wherein step (c) further comprises the steps of:

(i) orienting the valve in an initially closed position;

(ii) incrementally opening the valve until the measured current is substantially equal to the target current; and thereafter, (iii) adjusting the position of the valve to maintain the measured current substantially equal to the target current.

7. The method of claim 6, wherein step (a) further comprises the steps of:

(i) measuring voltage available to the blast motor;

(ii) determining a blast intensity value indicative of a relative rate of abrasive material to be passed through the valve; and (iii) determining the target current in relation to the measured voltage and the blast intensity value.

8. The method of claim 6, wherein the apparatus further comprises a wheel facilitating movement of the apparatus relative to the surface and a drive motor which drives the wheel, and wherein the method further comprises the step of:

(d) selectively applying current to the drive motor to accelerate the apparatus from an initial, nonmoving condition to an operational velocity.

9. The method of claim 8, further comprising the application of a timed delay of a predetermined value between the operation of step (c) and step (d), so as to improve the uniformity of the abrasion of the surface.

10. An apparatus for treating a surface by projecting abrading material at the surface comprising:

a centrifugal blast wheel for projecting abrading material onto the surface to be treated;

a blast motor for powering the centrifugal blast wheel;

a hopper for storing a supply of abrading material and supplying same to the centrifugal blast wheel;

a valve located between the hopper and the centrifugal blast wheel for controlling the rate at which the abrading material is supplied to the centrifugal blast wheel; and a control circuit for monitoring the current on the blast motor and adjusting the valve to maintain a uniform blast intensity by maintaining the current on the blast motor at a predetermined value.

11. The apparatus of claim 10 further comprising an encoder operably coupled to the valve and the control circuit for providing an indication of the relative position of the valve to the control circuit.

12. The apparatus of claim 10 further comprising a motor operatively connected to the valve and the control circuit for adjusting the position of the valve.

13. The apparatus of claim 10 further comprising a user interface for inputting the predetermined value of the current on the blast motor.

* * * * *

UNITED STATES PATENT AND TRADEMARK OFFICE

CERTIFICATE OF CORRECTION

PATENT NO : 5,975,985

DATED : November 2, 1999

INVENTOR(S) : James Brett Sutherland, et al.

It is certified that error appears in the above-identified patent and that said Letters Patent are hereby corrected as shown below:

Column 12, line 25 delete -- drive --

Signed and Sealed this

First Day of May, 2001

*Attest:*

Nicholas P. Godici

NICHOLAS P. GODICI

*Attesting Officer*

*Acting Director of the United States Patent and Trademark Office*